United States Patent [19]

Gudenau et al.

[11] 4,113,468

[45] Sep. 12, 1978

[54] CONTINUOUS SMELTING METHOD

[75] Inventors: H. W. Gudenau, Aachen; Horst König, Duisburg; Gero Rath, Mulheim; Haye Roth, Breitscheid, all of Fed. Rep. of Germany

[73] Assignee: Demag, A.G., Duisburg, Fed. Rep. of Germany

[21] Appl. No.: 771,748

[22] Filed: Feb. 24, 1977

[30] Foreign Application Priority Data

Feb. 28, 1976 [DE] Fed. Rep. of Germany ..... 2608320

[51] Int. Cl.$^2$ ..... C21C 5/52

[52] U.S. Cl. ..... 75/12; 75/11

[58] Field of Search ..... 75/10–12

[56] References Cited

U.S. PATENT DOCUMENTS

| | | | |
|---|---|---|---|
| 3,153,588 | 10/1964 | Madaras | 75/12 |
| 3,472,649 | 10/1969 | Sibakin | 75/10 R |

*Primary Examiner*—P. D. Rosenberg

*Attorney, Agent, or Firm*—Mandeville and Schweitzer

[57] ABSTRACT

A method is provided for producing steel with a very low carbon content of as low as 0.015% by continuously maintaining a foaming slag layer at a particular volume, and using as the charge a pre-reduced sponge with a specified carbon/oxygen ratio. The process includes utilizing a slag with a specific content of iron and magnesium oxide.

1 Claim, 1 Drawing Figure

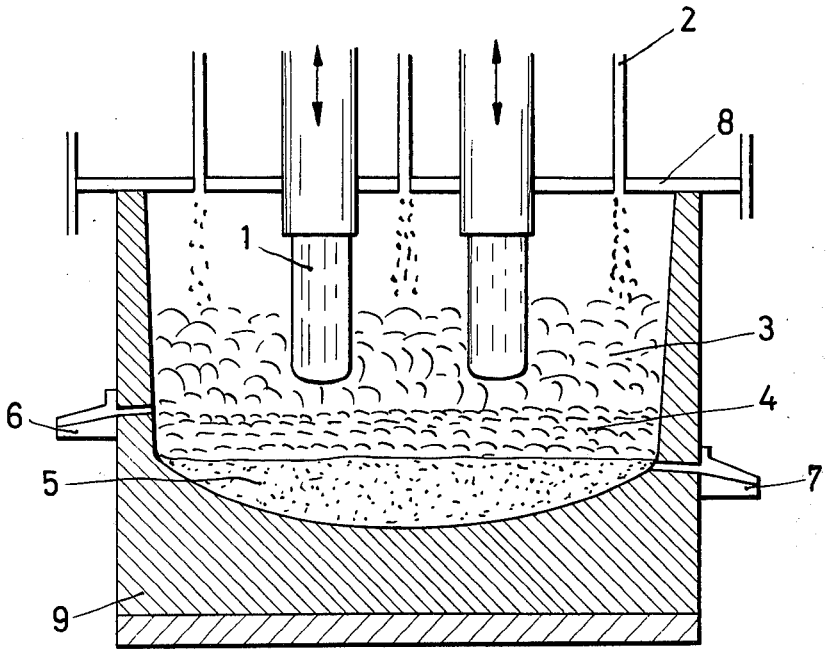
2
8
1
3
4
6
5
7
9

CONTINUOUS SMELTING METHOD

BACKGROUND AND STATEMENT OF THE INVENTION

The invention refers to a method of continuous smelting of high purity steel, particularly steel of extremely low carbon content. The smelting of such types of steel is of great interest because they may be used as basic product for a large variety of steel grades whose final composition is obtained by alloying additions in the ladle, for example, or in a subsequent metallurgical aggregate. It is imperative that such method can be realized economically and on an industrial scale.

It has already been proposed to produce iron extremely low in carbon by reducing iron ore in an electric arc furnace while maintaining a layer of at least 20 cm. thickness of liquid metal in the furnace, such layer being constantly covered by a liquid slag layer containing metal oxide of such thickness, so that the heat required in the upper portion of the slag layer to smelt the charge and for reduction is just about sufficient to maintain the metal layer in liquid condition without overheating it. In this method the carbon content of steel can be lowered to 0.05%. However, no further decrease is possible.

It has not been found possible to smelt steel of highest purity, practically technically pure iron, of lowest final carbon content of up to 0.015%, continuously and on a large industrial scale in a closed electric low shaft furnace with a slag layer covering the molten metal at all times, and with the electrodes immersed in such slag layer if the following conditions are met:

(a) pre-reduced iron sponge is charged containing carbon and oxygen in a ratio of at least 1 : 1.4;

(b) the slag layer is kept to a foaming degree of 1.2 to 5, whereby the foaming degree stands for the slag volume increase caused by foaming versus non-foaming slag, whose volume or "foaming degree" is indicated by "1";

(c) basic slag comprising $CaO/SiO_2$ of good liquidity is used, and reaction with a FeO content of 7 to 30%, and 5 to 12% MgO is used.

The method of our present invention uses the specific properties of iron sponge, including carbon which is present in free form the pre-reduction process, as well as chemically bound in $Fe_3C$, and FeO. The reactants FeO and C are, therefore, close together which creates good reaction conditions. At the same time, it is possible to maintain substantially constant the ratio of C and O in the iron sponge during the production process. Furthermore, iron sponge is highly porous and has a low specific weight compared to crude ore and slag. Finally, iron sponge is accompanied by slag components creating the condition for energy transmission by resistance heating in the electric low shaft furnace.

Proceeding in this manner will result in a variety of partially unexpected results. For example, not only is the C content minimized to 0.015% in the steel grades obtained, but the deliberate slag treatment largely eliminates the elements phosphorus and sulphur. Without any additional installations for further treatment, the cast steel has extremely low N values of below 0.001%. The iron yield is increased by largely avoiding combustion losses, and by operating with stoichoimetrically required lowest slag supplement quantities. The low combustion losses are due to operating with electrodes immersed in the slag, thus attaining a favorable specific energy consumption.

Another advantage of the invention is the low expenditure of refractory material. The smelting operation takes place continually, and therefor, no thermal variations occur such as during charging, which affect the vessel infeed areas. Immersion of the electrodes in the slag decreases heat radiation, and increases the life of the furnace charge opening area. As a stationary furnace receptacle is used, there is no mechanical stress on the refractory material. At the same time, the shell of the stationary furnace receptacle can be equipped with a water cooling device in the area at the top of the slag layer causing extensive stiffening of the slag adjacent the endangered wall areas, and further decreasing wear on the masonry. In addition, the stationary furnace receptacle permits slag-free tapping of steel, which increases the life of the ladle masonry by not subjecting it to the effects of the slag.

A furnace operated according to this method can work with inexpensive Soderberg electrodes. As mentioned, since the smelting heat is transmitted by resistance heating, there is no noise polluting the environment. Furthermore, a furnace, in accordance with the invention, can operate with an uncomplicated air purifying system as only small gas quantities are discharged. Again due to the small gas quantities occurring, losses due to evaporation are kept down.

The method according to the invention is as follows: In a standing furnace receptacle, electric energy is transformed continuously be electrodes immersed in the process slag into Joule heat, in a manner basically known, and this delivers the heat energy required for the further process, whereby the slag serves as the actual heating element. The charge material used, namely continuously charged iron sponge, has in its structural makeup the components FeO and carbon, whereby the carbon partially adheres to the pellet as free carbon, and is partially present in chemical bond with approximately 0.3% to 2% C in iron sponge as ferrocarbide ($Fe_3C$).

Principally, operation takes place with a hot foaming slag whose minimum thickness is 200 mm. This constantly maintained minimum thickness is guaranteed by the fact that the slag tap hole is located at least 200 mm above the metal tap hole. The foaming effect is achieved by the decarbonization reaction of the carbon contained in the iron sponge with FeO, also present in iron sponge, while forming a largely carbon-free iron and the gas component CO. The resulting CO foams while rising in the slag until it escapes into the furnace atomsphere.

For extensive decarbonization, it is necessary that the iron sponge does not penetrate the slag layer too fast. It is therfore purposely kept in a state of suspension and turbulence in the slag, until the reactions have been nearly completed. This state of suspension and turbulence can be controlled by an appropriate foaming degree in the slag. The so-called foaming degree in the slag is the factor by which the volume of the foaming slag increases compared to the volume of the normal slag without foaming effect, of "foaming degree 1". This foaming degree has, due to its lifting effect, considerable influence on the duration for which the iron sponge remains in the slag. The aim is a state of suspension keeping the iron sponge in the slag until it has been metallized completely into a droplet of iron, whereupon such iron droplet then sinks down on account of its specific weight.

This state of suspension and turbulene, where iron sponge until its formation into iron droplets is subjected to the kinetically most favorable condition for the course of the reactions, is obtained by a foaming degree of 1.2 to 5. This is achieved by a specific piece size for the iron sponge, the Carbon-Oxygen Ratio of the iron sponge, the viscosity and temperature of the slag, and the energy concentration. The charged iron sponge must have a C/O ratio of a minimum of 1 : 1.4, and preferably above that and about 1 : 1.55, in order to obtain steel grades of lowest C content of 0.015%, and high purity. By regulating to a large extent the duration for which the iron sponge remains in the slag until it is reduced to an iron droplet, also permits the desulphurization and dephosphorization reactions of the slag with the bare iron droplets partially taking place within the slag, which is extremely favorable from a kinetic point of view. The method of the invention can also be utilized with the addition of a certain portion of scrap to the iron sponge.

With the entire concept of resistance heating, the slag layer covering the metal bath, and the foaming or boiling effect, the N value in the steel is reduced to its minimum. Without any effort, N values of below 0.001% in the final product may be obtained, without the need for any subsequent treatment.

Another prerequisite for a good reactive process is a fluid and reactive slag whereby the MgO content is an essential control factor next to the basicity ($CaO/SiO_2$) required for desulfurization and dephosphorization, and the FeO content mainly required for decarbonization, which suitably lies between 7 and 30%. The MgO content should be between 5 and 12% after including all factors decisive for the process. The minimum slag quantity remaining constantly in the furnace, determined by the distance between metal tap and slag tap, permits operation with very low quantities of new slag resulting from the stoichiometrically required minimum slag quantity, which in turn has a positive effect on energy consumption. This slag layer constantly remaining in the furnace essentially contributes to a uniform, calm and electrically stable furnace operation. The resistance heating under constant steady conditions entirely eliminates flickering, strong variations in power consumption, short circuiting, and loud operation. The elimination of flickering and loud noises contribute considerably to the compatibility of the steel smelting technology of this invention with its environment.

During a test series, the iron sponge charged had the following chemical composition:

| | |
|---|---|
| CaO | 0.244 |
| $SiO_2$ | 1.550 |
| MgO | 0.398 |
| $Al_2O_3$ | 0.588 |
| C | 1.165 |
| Fe metal | 87.770 |
| FeO | 7.840 |
| V | 0.150 |
| Ti | 0.260 |
| S | 0.010 |

-continued

| | |
|---|---|
| P | 0.025 |

From this iron sponge, steel grades of the following final analysis were achieved by the methods, in accordance herewith:

| | | |
|---|---|---|
| C | 0.015–0.025% | |
| Si< | 0.01 | % |
| Mn | 0.01 | % |
| P | 0.005 | % |
| S | 0.004 | % |
| N | 0.001 | % |
| V | 0.01 | % |
| Ti | 0.01 | % |
| O | 0.1 | % |

The steel produced according to the invention had, in average values, a Fe content of minimum 98.82%, which is considered technically pure iron.

DESCRIPTION OF THE DRAWING

The drawing shows schematically an electric arc furnace operated in accordance with the method disclosed by out invention.

DETAILED DESCRIPTION OF A PREFERRED EMBODIMENT

1 indicates the electrodes, and 2 the charge openings in furnace receptacle 9. The metal bath 5 is covered by a slag layer whose lower portion 4 foams less, and whose upper portion 3 foams more. 6 is the slag tap hole, 7 the metal tap hole, whereby the latter is located below the slag tap hole 6 by the minimum thickness of the desired slag layer. The furnace cap is indicated at 8.

We claim:

1. A method for continuously making substantially pure steel having a very low carbon content in an electric low shaft resistance furnace, the steps comprising (a) maintaining a continuous slag layer in said furnace, said slag layer covering the molten metal therein;

(b) immersing the electrodes for said furnace in said slag layer;

(c) continuously charging said furnace with iron sponge; the improvement characterized by the steps of (d) pre-reducing said iron sponge prior to charging to a carbon/oxygen ratio of within the range of between about 1:1.4 and 1:1.55;

(e) increasing the volume of said slag layer in said furnace by foaming a portion of said slag layer, the ratio of the volume of the non-foaming portion of said slag layer to said foaming portion being within the range of between about 1 to 1.2 and 1 to 5 ;

(f) maintaining continuously said volume of said slag layer obtained in step (e);

(g) said increasing and maintaining steps being carried out with a fluid and reactive basic slag containing calcium oxide and silicon dioxide;

(h) said slag having an iron oxide content within the range of between about 7 and 30% and a magnesium oxide content within the range of between about 5 and 12%; and (i) withdrawing continuously said substantially pure product from said furnace.

* * * * *